United States Patent [19]

Mekonen

[11] Patent Number: 4,877,414

[45] Date of Patent: Oct. 31, 1989

[54] FUEL COMPOSITIONS

[76] Inventor: Kenneth Mekonen, 5601 N. Quincy Ave., Kansas City, Mo. 64119

[21] Appl. No.: 176,186

[22] Filed: Mar. 31, 1988

[51] Int. Cl.[4] ..... C10L 1/32

[52] U.S. Cl. ..... 44/51; 44/57; 44/62

[58] Field of Search ..... 44/51, 57, 62

[56] References Cited

U.S. PATENT DOCUMENTS

| | | | |
|---|---|---|---|
| 2,873,182 | 2/1959 | Kosmin | 44/56 |
| 4,083,698 | 4/1978 | Wengel et al. | 44/51 |
| 4,451,265 | 5/1984 | Schwab | 44/57 |
| 4,477,258 | 10/1984 | Lepain | 44/51 |
| 4,504,276 | 3/1985 | Baker | 44/51 |
| 4,744,796 | 5/1988 | Hazban et al. | 44/57 |

*Primary Examiner*—Jacqueline V. Howard
*Attorney, Agent, or Firm*—Thomas M. Scofield

[57] ABSTRACT

Improved hydrocarbon fuel compositions with a catalyst package preferably containing around 6.1 weight percent of (1) coupling/dispersing agents (surfactant), (2) a mono (alpha) olefin, (3) a pour point depressant, (4) a toluene aromatic and (5) an alkyl benzene; improved hydrocarbon fuels using as a catalyst the combination of an alpha olefin, a toluene aromatic and an alkyl benzene; hydrocarbon fuels utilizing at least one of a mono olefin and an alkyl benzene, preferably with other catalyst elements added thereto; water/hydrocarbon hydrosol fuel improvements preferably including the largest proportion of hydrocarbon fuel, a next largest proportion of water, at least one surfactant to form a hydrosol of the water and hydrocarbon fuel and preferably an additional catalyst package including (1) a mono olefin, (2) a pour point depressant, (3) a toluene aromatic and (4) an alkyl benzene, (5) calcium hydroxide addable if the water is not hard; water/hydrocarbon hydrosol fuels including a largest proportion of hydrocarbon fuel, a second largest proportion of water, one or more surfactants to form a hydrosol of the water and the hydrocarbon fuel and one to five or more additional catalyst elements, at least one of which is a mono olefin or an alkyl benzene.

41 Claims, No Drawings

FUEL COMPOSITIONS

BACKGROUND OF THE INVENTION

1. Field of Invention

The present invention is concerned with greatly improved fuel compositions having a number of desirable properties such as significantly increased combustion efficiencies so that the fuels are more economical in use. More particularly, it is concerned with such fuels which are supplemented by minor amounts of certain mono olefins (alpha olefins). The fuels of the invention include typical hydrocarbon fuels such as gasolines, diesel fuels or heavy fuel oils in combination with an appropriate mono olefin (alpha olefin) additive and also hydrosol fuels containing substantial fractions by weight percentage of water.

2. Description Of The Prior Art

A large number of additives have been proposed in the past for use with conventional hydrocarbon fuels such as gasoline, diesel fuel, heavy fuel oils or the like. In many cases, additives have been proposed to remedy specific problems, such as the elimination of knocking through the addition of tetraethyl lead to gasoline. Other agents have been also proposed for the purpose of enhancing combustion efficiency, and hence the work output drive per unit of fuel consumed.

While, as noted, the prior art is replete with attempts at providing significant enhancement of combustion efficiency, few if any truly successful additives have been discovered.

Researchers in the art have also proposed that significant quantities of water could be added to liquid hydrocarbon fuels to form a combustible emulsion which would, theoretically, lessen the consumption of the expensive hydrocarbon fuels. Indeed, such proposals extend back to the late 19th Century. Here again, however, no truly successful fuel/water emulsion has been developed in the past, with the limited exception of such disclosed in the presently styled, pending U.S. patent application of Kenneth (nmi) Mekonen et al, Ser. No. 06/625,045, filed June 27, 1984 for "Improved Fuel Combustions". The subject fuels and fuel/water hydrosol herein disclosed is an improvement over such disclosed in the just named currently pending patent application.

The numerous problems heretofore experienced with such emulsified fuels as are seen in said U.S. Ser. No. 06/625,045, include the fact that, when relatively large quantities of water are present, the combustion temperature is lowered. Moreover, the presence of substantial water lowers the overall caloric value of the fuel. Finally, many prior disclosed fuel/water emulsions are relatively unstable, tending to separate in two parts over time. Of course, if large quantities of surfactants are employed in such emulsions, the problem of phase separation can be avoided. However, this is inherently a very expensive proposition, and, therefore, in order to be truly economical, the amount of surfactant(s) employed in an emulsified fuel must be relatively small.

OBJECTS OF THE INVENTION

A first and basic object of the subject invention is to make substantial improvements over the disclosure of fuel compositions and additives made in the presently pending U.S. patent application Mekonen et al, Ser. No. 06/625,045, filed June 27, 1984 for "Improved Fuel Compositions".

Another object of the invention is to provide sets and systems of chemical additives with respect to hydrocarbon fuels, per se and, as well, hydrosol fuels including a hydrocarbon component and a major water component.

Another object of the invention is to provide fuel compositions of hydrocarbons and additives, as well as hydrocarbons water and additives wherein less labor is required to manufacture or prepare such fuels (for example, these fuels not being viscuous or needing heat in the cold months), wherein there are no nitrogen or sulfur bearing additives used in the fuel and fuel hydrosol compositions and wherein the cost of providing such fuel and fuel hydrosol compositions is substantially reduced.

Still another object is to provide such fuel compositions and hydrosol fuel compositions which combust with substantially lowered NOX and SOX emission.

Yet further, another object of the invention is to provide such hydrocarbon fuel and hydrocarbon hydrosol fuel compositions which require less quantities of surfactants therewith as surfactants.

Other objects of the invention will appear in the course of the following description thereof.

SUMMARY OF THE INVENTION

It has now been discovered that greatly improved fuel compositions can be provided which overcome not only many of the intractable problems discussed above, but also those problems inherent in the presently styled disclosure of the presently pending U.S. patent application Mekonen et al, Ser. No. 06/625,045, filed June 27, 1984 for "Improved Fuel Compositions". Broadly speaking, the present invention resides in the discovery that use of certain types of mono olefin (alpha olefin) compounds, typically in relatively minor amounts, will give significantly enhanced combustion efficiency.

In one aspect of the invention, an improved fuel essentially free of lubricating oil is provided The fuel comprises (and preferably consists essentially of) a combustible hydrocarbon material and up to about 3.4% by weight of a mono (alpha) olefinic additive.

The type and amount of additives serve to increase the work output per unit of fuel obtained using the improved fuel, as compared with the work output per unit of fuel obtained under the same conditions and using the identical fuel except for the absence of the mono (alpha) olefinic additive therein. The additive is selected from the group consisting of mono or alpha olefins having 7 to 15 recurring $CH_2$ monomers therein.

In preferred forms, the hydrocarbon material is selected from the group consisting of liquid hydrocarbons such as the gasolines, diesel fuels and heavy fuel oils of virtually any specific composition and type. The mono (or alpha) olefinic additive (the most preferred mono or alpha olefinic additive being decene-1) is advantageously present at a range of from about 7 to 13 $CH_2$ monomers. Those skilled in the art will recognize that the specific amount of mono or alpha olefin (olefinic additive) to be employed in a particular situation depends upon the hydrocarbon base material being employed, and the desired characteristics in the ultimate mono (or alpha) olefin supplemented fuel.

Hereinafter the terms "mono olefin" and "alpha olefin" are considered to connote the same substances.

A wide variety of mono olefinic additives can be used in the context of the invention. While mono olefins having 7 to 15 recurring monomers can be used, the most preferred mono olefins have 7 to 13 recurring $CH_2$ monomers therein. In addition to the most preferred decene-1 additive, additives such as dodecine-1, tetra decene-1 and hexadecene-1 can be employed.

In another aspect of the invention, a hydrosol is created by adding a metal hydroxide such as calcium, aluminum and magnesium hydroxides to the hydrocarbon fuel, water and surfactant. Such hydroxides will combine with the sulfur and nitrogen compounds on combustion of the fuel, thus minimizing and/or eliminating the emission of noxious gases causing acid rain and other environmental hazards. When the mono olefinic additive and/or alkyl benzene and/or toluene (3 methyl pentane) and/or 2-methoxy ethenol are added, such additions give further improvements in power, and/or lubrication and/or pour point depression.

In certain forms of the invention, use can also be made of additional additives such as an aromatic compound (e.g., toluene and selected alkyl benzenes) and another fuel different than the base hydrocarbon (e.g., diesel fuel in place of a gasoline-based fuel and vice versa).

In another aspect of the invention, liquid hydrosol fuels are provided which broadly include respective quantities of a liquid hydrocarbon combustible fuel, water, at least one surfactant and an additive selected from the group consisting of mono olefins (alpha olefins) having 7 to 15 recurring $CH_2$ monomers therein. Here again, the combustible fuel is advantageously selected from the group consisting of the gasolines, diesel fuels and heavy fuel oils, although other possibilities such as the residual oils may also be employed.

Preferably, the combustible fuel component is present at a level of from about 65% to 97% by weight, and more preferably from about 65% to 9% by weight. On the other hand, the water fraction is preferably present at a level of from about 5% to 25% by weight and, most preferably, from 20% to 25% by weight. In the case of hydrosol fuels, the mono olefinic additive may be present at a level up to about 3.4% by weight, and more preferably at a level of from about 0.05% to 3.4% by weight.

Various types of surfactants can be employed in the invention, in order to produce stable hydrosols having good handling and combustion characteristics. Broadly speaking, one or more surfactants can be used, although in practice it has been found that a combination of surfactants is best suited to the purposes of the invention. The surfactants should be present at a level of up to about 5% by weight, preferably 1.0% to 2.5% by weight, but in this case, the prime consideration is one of cost. That is, an excess amount of surfactant may not deleteriously effect the characteristic of the fuel, but would be impractical from an economic standpoint.

DESCRIPTION OF THE PREFERRED EMBODIMENTS

In the production of non-hydrosol fuels in accordance with the invention, the selected mono or alpha olefin additive is simply mixed with the hydrocarbon base fuel at the desired level of addition. The most preferred hydrocarbon bases are the gasolines and diesel fuels (particularly #2 diesel fuel), whereas the mono olefin additive is most preferably decene-1. In the latter connection, the decene-1 additives should be dissolvable in the hydrocarbon fuel being used.

One particular commercially available compound, decene-1, used to good effect in the invention is commercialized by Gulf Oil Company as "Gulftene 10". This material is a water white to amber colored chemical, an alkene, that is, an unsaturated, chemically active hydrocarbon with one carbon to carbon double bond. It is an oily liquid of moderate to low viscosity. The chemical and physical properties of this product are set forth in a publication from the manufacturer (Gulf Oil) entitled "Gulftene Alpha Olefin-Data Gulftene 10-Decene-1" product information sheet #AO 10-667st. This data sheet is incorporated by reference herein. Briefly, however, the decene-1 material has a specific gravity at 60°/60° F. of 0.745 and an average molecular weight of 140.268.

The presently most preferred non-emulsified fuel composition consists of essentially about 98.5% of base hydrocarbon fuel, particularly gasoline or #2 diesel oil, along with up to 3.4% of alpha olefin admixed therein (and/or alkyl benzene up to the same level). A specific example of an alkyl benzene is zerol, 150 (dimerized propylene tetramer.)

In the context of hydrosol fuels, the most preferred fuel additives include decene-1 in a grade comparable to Gulftene 10, along with a substantial fraction of water in order to form a water-in-fuel hydrosol. Hydrosol creating surfactants or the equivalent must be also present. Here again, a wide variety of fuels can be employed, but the presently preferred hydrocarbon base fuels include members taken from the group consisting of the gasolines, diesel fuels and heavy fuel oils. No. 1, No. 2, No. 3, No. 4, No. 5 and No. 6 oils may be employed. Of these, No. 1, No. 2 and No. 3 are regarded as diesel fuels, while No. 4, No. 5 and No. 6 are regarded as heavy fuel oils.

In terms of surfactants, the most preferred combination includes, respectively, minor amounts of three coupling/dispersing agents, specifically: Emsorb-2500 (sorbitan mono oleate), sold by Emery Chemical, Emsorb-2502 (sorbitan sesquioleate) and Trycol DA-6 (polyoxy ethylene (6) decyl alcohol). Emery Industries data sheets are in hand on these compounds. Sorbitan monotallate and sorbitan ditallate also may be used, as well as 9-Octadenoic acid calcium, (magnesium, zinc or aluminum salts) to replace one of the listed coupling/dispersing agents.

In addition, however, various other kinds of surfactants can be used to good effect in the invention. As those skilled in the art will readily perceive, however, an extremely large number of specific surfactants and combinations thereof can be used in the invention, as long as the aims thereof are achieved. In addition, the preferred surfactant package may have applicability in other types of emulsified fuels which do not contain the mono olefinic (alpha olefinic) additive therein.

TABLE 1

| PREFERRED HYDROSOL FUEL CONSTITUENTS | RANGE | MOST PREFERRED |
|---|---|---|
| 1. #2 Diesel Oil | 67.80–93.40 | 77.90 |
| 2. Water | 5.00–25.00 | 20.00 |
| 3. Total Coupling/Dispersing Agents | 1.00–2.50 | .90 |
| 4. Emsorb-2500 (Sorbitan Monoleate) | .55–1.05 | .40 |

TABLE 1-continued

| PREFERRED HYDROSOL FUEL CONSTITUENTS | RANGE | MOST PREFERRED |
|---|---|---|
| 5. Emsorb-6915 (Sorbitan Sesquioleate) | .40–1.05 | .40 |
| 6. Trycol DA-6 (POE (6) Decyl Alcohol) | .05–.20 | .10 |
| 7. Gulftene-10 (Decene-1) | .05–.20 | .10 |
| 8. Amsco Solv-EE (2-methoxyl ethanol) | .05–.20 | .10 |
| 9. Toluene (3-methylpentane) | .40–3.00 | .80 |
| 10. Alkyl Benzene Zerol-150 (Dimerized propylene tetramer) | .05–.20 | .10 |
| 11. Calcium Hydroxide (Ca(OH)2 (available oxide) | .05–.20 | .10 |

In order to produce hydrosols in accordance with the invention, it is preferred to first mix the surfactant(s) to be employed, whereupon these surfactant(s) are added to the hydrocarbon base material (with sufficient mixing to insure complete dissolution). At this point, the water is added, again with mixing to assure a relatively even dispersion. The preferred surfactant package disclosed herewithin above greatly facilitates the mixing procedure, preferably using an in-line static mixer or an homogenizer. In the case of gasoline based hydrosols, it is estimated that the average particle diameter of the water in the hydrosol is approximately 10(−3) to 10(−4) microns.

In addition to the hydrocarbon fuel, water, coupling/dispersing agents (surfactants) and alpha or mono olefins (and/or an alkyl benzene it should be noted that Amsco solve-EE (2-methoxyl ethanol) may be added in a weight range of 0.05% to 0.20%. This acts as a pour point depressant. Yet further, toluene (3-methyl pentane) may be added in the weight range of 0.40% to 3.0%. Likewise, Zerol-150, an alkyl benzene, (dimerized propylene tetramer), average mol. wt. of 330) may be present in the amount of 0.05 to 0.20% weight percent. In the event that decene-1, toluene and the latter tetramer compound are all three present, the total weight percent of the sum thereof should not exceed 3.4% by weight. Alternatively, decene-1 (the alpha olefin) may be combined with either toluene alone or zerol-150 (alkyl benzene) alone, again with the optimum weight percent range thereof from 0.05% to 3.4% by weight. (This alpha olefin, per se, may substitute for both toluene and the tetramer in the range up to 3.4%) The alkyl benzene in the range of 0.1 to 0.4 may replace the alpha olefin. Calcium hydroxide or the noted salts may be added in the weight percent range of 0.05% to 0.20%. Depending on the locale, such calcium hydroxide may be added in solution in the water. See below for other alternatives.

The effect of the alpha olefin is to obtain critical power increase from cleavage of the hydrocarbon compound molecules. Toluene also offers critical power increase and is cheaper than the alpha olefin, toluene also aiding in controlling the viscosity of the hydrosol. The alkyl benzene is present particularly for improving lubricity of the fuel and cleavage of the molecules, aiding the hydrosol.

While the inventor does not wish to be bound to any specific theory as to why the mono (alpha) olefinic additives (and/or alkyl benzene additives) of the invention give such outstanding results, it is hypothesized that such additives in some way initiate or promote reactions analogous to cracking during the combustion of the mono olefin (or alkyl benzene) supplemented fuel compositions thereof. Under this line of reasoning, such reactions would produce smaller, lower molecular weight hydrocarbons, which are known to be more readily combustible. Therefore, the exothermic heats of reaction would theoretically add substantially to the caloric value obtained from the fuels.

While the foregoing disclosure has been primarily directed to the use of liquid hydrocarbon base materials, it is also believed that the combustibility of solid hydrocarbon material such as coal can be enhanced through the use of the mono-olefinic agents and/or alkyl benzenes. In such a context, the mono-olefinic material and/or alkyl benzene could be simply sprayed upon solid or crushed coal in order to give enhanced combustion characteristics or, alternatively, the mono olefinic agents and/or alkyl benzenes could be added to coal/-liquid suspensions. Use of the specified fuel catalyst package in hydrosol and non-hydrosol fuel is optimum.

With respect to the hydrosol fuel set forth in elements 1 through 11 in the table. It should be noted that, in localities where the water supplied in this hydrosol fuel is hard, containing calcium hydroxide, element 11 may not have to be added. On the other hand, if the water supplied in a given locale is soft, the addition of the calcium hydroxide is most desirable.

At this point, certain functional facts will be recorded with respect to the 11 (actually 10 because element 3 refers to 4, 5 and 6) elements constituting the hydrosol fuel constituents in the preceding table. First, as noted, the calcium hydroxide is to aid in controlling noxious emissions in the burning of the hydrosol fuel set forth. Secondly, elements 7, 9 and 10 (Gulfene-10; decene-1); toluene (3 methylpentane) and zerol-150 (dimerized propylene tetramer), the alkyl benzene, are all basically present for added power in both the hydrocarbon, per se and hydrosol fuels.

The mono-olefin, element 7, and an alkyl benzene (10) are constituents of both hydrocarbon fuels, per se and the hydrosol fuels disclosed. Such obtain critical power from the cleavage of the hydrocarbon monocules. This mono-olefin element can substitute for element (9) toluene or element (10), the alkyl benzene, or both. Element 10 can substitute for elements 7 and 9, one or both. However, to the extent (7) or (10) is used to substitute for one or the other or both, the level of the mono-olefin or alkyl benzene must be raised to the total level of the two or three indicated, both range given and level most preferred. Thus, if element 7 substitutes both for 9 and 10, the range of the mono-olefin will be 0.5 to 3.4% by weight. The most preferred range in this case will be 1.0% by weight. Likewise with element (10).

Element 8 (Amsco solv-EE 2-methoxy ethanol) acts as a pour point depressant. For cold climates, this or the equivalent is necessary to avoid freeze out.

With respect to element 9, toluene, this additive is for power plus a cheaper control of the viscosity of the hydrosol, in the case of the hydrosol fuel. It is optional, provided elements 7 and/or 10 are increased proportionally.

Element 10, the alkyl benzene, (example zerol-150) aids the lubricity of the fuel and cleavage of the hydrocarbon molecules. Its presence, per se, is preferred as it also aids maintenance of the hydrosol condition, but optional, provided elements 7 and/or 9 are increased proportionately to the total figures given in the table.

$SO_x$ AND $NO_x$ REDUCTIONS IN THE COMBUSTION OF HYDROSOL DISTILLATE FUELS, A QUANTITATIVE ASSESSMENT

Whenever sulfur and nitrogen containing hydrocarbon fuels are burned, oxides of sulfur and nitrogen are invariably emitted into the atmosphere as $SO_2$ and $SO_3$ ($SO_x$) and as NO and $NO_2$ ($NO_x$), as will be stated hereunder.

These emissions result in an environmentally hazardous chain reaction of massive proportions that drastically affect our global ecological balance and welfare.

By utilizing Hydrosol Distillate Fuels, as the following illustrations and examples will show, substantial amounts of both $SO_x$ and $NO_x$ will be eliminated, thereby contributing to the re-establishment of our ecological balance.

EXAMPLE - 1

| |
|---|
| (a) $S + O_2 \ldots SO_2$ |
| (b) $SO_2$ (0) . . . $SO_3$ |

In contact with moisture in the form of water droplets in the atmosphere we have:

| |
|---|
| In (c) $SO_2 + H_2O \ldots H_2SO_3$ (Sulfurous acid) |
| & In (d) $SO_3 + H_2O \ldots H_2SO_4$ (Sulfuric acid) |

In the Hydrosol Distillate Fuel, $Ca(OH)_2$ Solution is used at the level of 1.0 wt. percent CaO content.

Hydrosol Distillate Fuel #521/3 (see Table I) utilizes 20% wt. of this solution in which $Ca(OH)_2$ is designated the monenclature "X".

Hence in 100# of Hydrosol Distillate Fuel we have available: $20 \times 454 \times 0.01 = 90.80$ gms. CaO. (56.08 being the mg. mol. wt. of CaO)

| Illustration - 1 | | | | |
|---|---|---|---|---|
| | 56.08 | 82.0 | 120.08 | 18.0 |
| (a) | CaO + | $H_2SO_3 \ldots$ | CA $SO_3$ + | $H_2$ |
| (b) | 56.08 | 98.0 | 136.08 | 18.0 |
| | CaO + | $H_2SO_4 \ldots$ | Ca $SO_4$ + | $H_2O$ |

From the foregoing we find: In $$\frac{730.03205 \times 120.08}{56.08} = 1563.164 \text{ gms. } (3.443\#) \quad (a)$$

$CaSO_3$ will be produced/100 gal. hydrosol Fuel burned and in $$\frac{730.03205 \times 136.08}{56.08} = 1771.4471 \text{ gms. } (3.902\#) \quad (b)$$

$CaSO_4$ will be produced/100 gal. Hydrosol Fuel burned And still further: In

| | | | | |
|---|---|---|---|---|
| (a) | 56.08 | 82.0 | 120.08 | 18.0 |
| | CaO + | $H_2SO_3 \ldots$ | $CaSO_3$ + | $H_2O$ |

It follows that 64 gms $SO_2$ yields 120.08 gms. $CaSO_3$.

Hence for every 100 gal. Hydrosol Fuel burned $$\frac{1563.164 \times 64}{120.08} + 833.13199 \text{ gms. } (1.8351\#) \ SO_2$$

are tied up as insoluble particulates. And in

| | | | | |
|---|---|---|---|---|
| 56.08 | 98.0 | 136.08 | 18 | (b) |
| CaO + | $H_2SO_4 \ldots$ | $CaSO_4$ + | $H_2O$ | |

It therefore follows that 80 gms. $SO_3$ yields 136.08 gms $CaSO_4$.

Hence for 100 gal. Hydrosol Fuel burned $$\frac{1771.4471 \times 80.0}{136.08} + 1040.415 \text{ gms. } (2.2938656\#)$$

$SO_3$ are tied up as insoluble particulates.

EXAMPLE 11

| | |
|---|---|
| (a) | $N_2 + O_2 \ldots 2NO$ |
| | $NO + H_2O \ldots 2NHO_2$ (Nitrous Acid) |
| (b) | $2NO_2\ O_2 \ldots 2NO_2$ |
| | $NO_2 + H_2O \ldots 2HNO_3$ (Nitric Acid) |

| Illustration 11 | | | | |
|---|---|---|---|---|
| (a) | 56.08 | 62.0 | 132.08 | 18 |
| | CaO + | $2HNO_2 \ldots$ | $Ca(NO_2)_2$ + | $H_2O$ |

It therefore follows that 30 gms. NO yields 160.08 gms. Ca $(NO_2)_2$ and subsequently Ca $(NO_2)_2 + O_2 \ldots$ Ca$(NO_3)_2$ Hence for every 100 gal. Hydrosol Fuel burned $$\frac{730.03205 \times 164.08}{56.08} = 2135.9424 \text{ gms. of } Ca(NO_3)_2$$

will be produced and:

$$\frac{2135.9424 \times 30}{164.08} \text{ gms. NO}$$

are tied up/100 gal. H.F. burned = 390.53066 gms. (0.860#) as insoluble particulates or 1069.7142 (2.356#) Nitrous Acid (6.325 lbs/ton

| | | |
|---|---|---|
| (b) | 56.08 | 164. 18.0 |
| | CaO + $2HNO_3 \ldots$ | $Ca(NO_3)_2$ |

Hence $$\frac{730.03205 \times 164.08}{56.08} = 2135.9424 \text{ gms } Ca(NO_3)_2$$

will be produced/100 gal. Hydrosol Fuel burned And:

$$\frac{2135.9424}{164.08} = 598.81368 \text{ gms. } (1.319\#)$$

$NO_2$ are tied up 100/gal. Hydrosol Fuel burned as insoluble particulates or 1640.2286 gms. (3.6128#) Nitric Acid. (9.7 lbs/ton).

With respect to the table previously set forth herewithin, it should be understood that both the optimum hydrosol and nonhydrosol fuels are therein defined. In the hydrosol use, water in the range of 5% to 25% by weight, optimum 20% by weight, is employed. In the nonhydrosol fuels, element (2) or water is simply omitted. The catalyst package then comprises, for the hydrocarbon fuel, which fuel typically will be present in the 93.7–99.4 percent weight percent range (optimum 97.9%) the remaining weight percent volume of the non-hydrosol fuel. The elements 3–10, inclusive or 3–11, inclusive comprise, then, the optimum catalyst package which is utilized with elements 1 and 2 (fuel and water) in the hydrosol situation or case, as well as the optimum catalyst package, per se, with respect to the essentially nonwater diluted hydrocarbon fuel.

IMPROVED HYDROCARBON FUELS

The first example of utility of the non-hydrosol fuel is the combination of the hydrocarbon fuel solely with the surfactant package in the ranges given. These are table elements 3–6, inclusive in the ranges and most preferred examples given. One point to the utility of this portion of the catalyst package is that the surfactant(s) will couple any water which may be in the fuel or tank before fueling, thereby to get a smoother burn.

A second utility minimal example is the combination of the hydrocarbon fuel (1) with a monolefin, such as element (7), in the range herebelow given. The further combination of elements 3–6, inclusive, in the ratios shown, with element 7, the mono olefin, in the range stated herebelow is a third utility combination which, again, acts to couple any water in the fuel or tank to get a smooth burn plus the power addition through element 7. In the event that a mono olefin is used, per se, or with the surfactant package, such mono olefin, in both cases, should be present in the totaled ranges of element 7, 9 and 10 (0.50–3.4 weight percent) and also the total-led quantities thereof most preferred, thus, in the latter case, 1.00 weight percent.

The fourth combination with utility is the hydrocarbon fuel, per se with element 7, the mono olefin and element 10, the alkyl benzene. The presence of these two elements should be in the total most preferred and totaled ranges given for the combination of elements 7, 9 and 10 as set forth hereabove. Further, adding the surfactant package 3–6, inclusive to the stated mono olefin plus alkyl benzene catalyst package gives a fuel mixture with additional utility (a fifth such).

The sixth utility example, is the combination of the hydrocarbon fuel, per se, with an alkyl benzene (element 10). The latter should be present in the totaled range weight percents of element 7, 9 and 10 of the Table or the totaled optimum weight percents given. The further combination with the fuel and the alkyl benzene of surfactant elements 3–6 or their equivalent, in the range ratio shown and optimum ratio shown is a seventh utility combination which combines the advantages of the surfactant in the hydrocarbon fuel, per se, plus the benefits of the alkyl benzene. The totaled ranges are 0.50–3.4 weight percent of alkyl benzene or, as optimum, 1.0 weight percent.

With respect to the hydrocarbon and the combination therewith of a mono olefin, per se (7) or an alkyl benzene (10) per se, the addition of toluene in the stated range or most preferred quantity plus the mono olefin or alkyl benzene in the amounts combined for elements 7 and 10 is further useful. To these options also can be added the surfactant package 3–6, inclusive or equivalent.

A next combination for a hydrocarbon fuel, per se is the said hydrocarbon fuel, with elements 7 (mono olefin), 9 (toluene) and 10 (alkyl benzene) in the ranges or most preferred amounts as shown. To this option, also can be added the surfactant package 3–6, inclusive or equivalent coupling/dispersing agents.

The combination, per se of the hydrocarbons and element 8, the pour point depressant, is of some utility. The combination of the hydrocarbon plus surfactant package plus the element 8 in the quantity specified has additional utility.

The hydrocarbon fuel plus elements 8 and 9 with the total of 9 being in the amounts accumulating 7, 9 and 10, inclusive in the ranges or most preferred has utility.

The combination of the hydrocarbon, the pour point depressant (8) and the alkyl benzene (10), the latter in the total ranges and optimum amounts given of elements 7, 9 and 10 in the table, is also of utility.

In a catalyst package with or without the surfactant elements 3–6, inclusive, element 7, the mono olefin or element 10, the alkyl benzene and element 9 may be employed with either 7 or 10 or both thereof being present in the cumulative ranges and ideal amounts specified for elements 7 and 10.

Calcium hydroxide, in the effect of available oxide, in the amounts specified with respect to element 11, can be advantageously used with any of the foregoing hydrocarbon fuel/catalyst package specifications.

HYDROSOL FUELS

The optimum hydrosol fuel is defined by elements 1–10, inclusive from the previous Table, with element 11 best also present if the water is not of a hard character. That is, the hydrosol fuel thus contains (1) a hydrocarbon fuel, (2) water, (3) one or more effective coupling/dispersing agents (3–6, inclusive) to create a hydrosol, (4) a mono olefin (7), (5) a pour point depressant (8), (6) toluene (9) and (7) an alkyl benzene (10). Preferred specific compounds for these elements are also listed in the preceding table as well as useable ranges and optimum levels of inclusion.

When a hydrosol fuel is discussed in the following, it is always assumed that there is a hydrocarbon fuel (1) in the range of or at the most preferred weight percentage present as well as (2) water in the range or at the preferred quantity given in the table. Yet further the coupling/dispersing agents 3–6 or equivalent must be present. This group of three elements is taken for granted and the remainder of the catalyst package may be manipulated somewhat, retaining utility, despite the omission and/or substituting of certain of the specific elements listed as follows.

Thus, it is understood that elements 1 (hydrocarbon fuel) and 2 (water) are not of utility, per se. At least the surfactant package 3–6 or the equivalent in the ranges or optimum levels given must be present to create the basic hydrosol. The subject hydrosol fuel invention involves the catalyst package elements in certain combinations with the fuel and water.

Thereafter, the addition of element 7, the mono olefin, per se, in the combined amounts up to such specified for elements 7, 9 and 10, is of great utility (0.50 to 3.4% by weight.)

The utility of using the fuel, water and surfactant package with element 9 alone is not of comparable utility or considerable value. However, again, the elements 1–6, inclusive plus element 10, the alkyl benzene, the latter present in the combined amounts of elements 7, 9 and 10 called out in the table, has equivalent utility to the combination of elements 1–6 and 7.

Of further utility, then, is the combination of element 7 (mono olefin) or element 10 alkyl benzene, per se and element 9 (toluene), with either the mono olefin or AB being present in the table called out combined quantities of elements 7 and 10.

Analogous to the previously called out HC fuel subcombinations, elements 1–6, inclusive, with 9 and 10 or with 7 and 9 with either 7 or 10 in each formula being present in the stated combined quantities of elements 7 and 10, has utility.

The basic combination of hydrocarbon, water and surfactant package is substantially aided by the addition of element 8 in the quantity indicated. It is also true that element 7 plus 8, with 7 present in the combined quantities of 7, 9 and 10, has considerable utility. Yet further, the combination of elements 8 and 10 1 with the quantity of alkyl benzene (10) present being in the specified totals of 7, 9 and 10, is also of like utility.

Still further, the combination of element 8 with both of elements 7 and 10 is of utility, the total quantity of the latter two elements present being in the range and at the most preferred levels of the total of elements 7, 9 and 10 given in the table.

With respect to the optimum catalyst package given, a single surfactant or coupling/dispersing agent such as sorbitan monotallate or sorbitan ditallate may be used, either or both in the cumulative range or optimum amounts specified for elements 3 or 4–6 inclusive.

The presence of element 10, the alkyl benzene, is directed to the lubrication or lubricity of the fuel, as well as cleavage of the fuel molecules. This component further helps form and maintain the hydrosol. Thus, it is preferred, but optional if the proportional increase of elements 7 and/or 9 takes place.

ENGINE EMISSIONS

Reduction of noxious engine emissions utilizing a hydrosol fuel of the nature specified in the before given table, as well as a hydrocarbon fuel, per se, with the catalyst package elements 3–11, inclusive, per se, was achieved when compared with the emissions of a No. 2 diesel reference fuel as a control.

The diesel engine run on Mar. 12, 1988 was a Mercedes 2200 four cylinder diesel engine installed in a 1973 Mercedes Benz four door sedan. The emission test analyzer employed was the Sun Exhaust Analyzer SGA-9000. In all the tests, the vehicle motor was run at 1400 rpm.

With respect to the No. 2 diesel reference fuel, per se, the results comprised hydrocarbons 17 ppm, carbon dioxide 1.86%, carbon monoxide 0.05% and oxygen 18.3%.

Utilizing the hydrocarbon preferred fuel set forth in the foregoing table, specifically, No. 2 diesel oil plus elements 3–11, inclusive in the amount specified as most preferred gave results including hydrocarbons 12 ppm, $CO_2$ 1.88%, CO 0.06% and $O_2$ 21.8%.

Using the hydrosol distillate fuel of the foregoing table, constituting elements 1–11, inclusive in the amounts specified as most preferred, the results were HC 0 ppm, $CO_2$ 5.82%, CO 0.02% and $O_2$ 15.6%. Thus it may be seen that the hydrocarbon emissions with respect to the diesel reference fuel was substantially reduced in the subject optimum nonhydrosol fuel and greatly reduced in the subject optimum hydrosol fuel.

With respect to the hydrosol and nonhydrosol fuels herein disclosed, the alpha or mono olefins that can be employed include decene-1, dodecene-1, tetradecene-1, hexadecene-1 and octadecene-1. These, respectively, have 7, 9, 11, 13, 15 and 17 recurring $CH_2$ monomers therewithin. These are useful as element 7 of the first Table.

With respect to element 9, given as toluene, in this application, element 9 may be referred to as "toluene aromatics", a group of compounds which include benzene, toluene, ethylbenzene, p-xylene, m-xylene, o-xylene, cumene, n-propyl benzene and pseudocumene. Each of these toluene aromatics may be employed as element 9 in the ratios and optimum level there given in place of specific toluene, per se.

With respect to the testing data "Performance Testing Of Diesel Fuel Additives" hereinbefore set forth, three test series are specified.

Numerous useful pour depressant compounds may be substituted for the specific example of element 8. Without limiting this category, a publication of the Dow Chemical Company, Dowanol Glycol Ether Development, 1710 Building, Midland, Mich. 48640 lists 13 Dowanol glycol ethers including EM, EE, DM, DE, TM, TE, TB, PM, DPM, TPM, PiB-T, EPh, PPh. The first three members of this list comprising ethylene glycol methyl ether, Cas No. 109-86-4, ethylene glycol ethyl ether, Cas No. 110-80-5 and diethylene glycol methyl ether, Cas No. 111-77-3. The Cas numbers are Chemical Abstract Service, American Chemical Society. The chemical compositions of these glycol ethers and physical properties are available in my hands. For example, the last compound mentioned is propylene glycol phenyl ether, two CAS numbers 770-35-4 and 4169-04-4. This is $C_6H_5$-O-$C_3H_6OH$. The information describing and identifying the Dowanol glycol ethers listed is herein incorporated by reference, is it is in applicant's hands.

Returning to the Test Series characterizations, the first test series uses standard No. 2 diesel fuel with no catalyst or water additive. Thus it is just the specific HC fuel. The second series used a fuel composed of 98% by weight No. 2 diesel and 2% catalyst, the latter comprising the most preferred quantities of elements 4, 5, 6, 7, 8, 9 and 10 from the first Table herein. The third series used a fuel composed of 78% No. 2 diesel fuel, 20% water (saturated with calcium hydroxide to give the most preferred range of element 11 in available oxide) and the 2% catalyst comprising elements 4–10, inclusive in the most preferred levels given in the first Table heretofore. The calcium hydroxide is referred to on page 1 of the "Performance Testing . . . " section, under "Testing Methods", first paragraph, last sentence ". . . as an additional additive 'X'".

As previously discussed, the catalyst may comprise just an alpha olefin, element 7, omitting elements 9 and 10. However, this is not preferred. Likewise, the catalyst may include just element 10, an alpha benzene, omitting elements 7 and 9. Again, this is not preferred. The combination of element 7 and element 10 will produce better performance than the use of either element 7 or element 10 alone. Likewise, one can combine elements 7 and 9 (and110 and 9) and such combinations will be better than either element 7 or element 10 alone. However, the optimum catalyst formula includes each of element 7, an alpha olefin, element 9, a toluene aromatic and element 10, an alkyl benzene.

Both the alkyl benzene and toluene aromatics aid in stabilizing the hydrosol. The toluene aromatic is currently cheaper than the olefins and alkyl benzenes. Toluene also aids in lowering the viscosity. The alkyl benzene also lowers the freezing point.

The specific alkyl benzene disclosed is a 100% alkyl benzene, a branched alkyl benzene made from propylene and benzene. This compound involves 15 to 18 carbon atoms in branches on the benzene ring.

Thus it is seen that the subject invention makes substantial improvements over the disclosure of U.S. Ser. No. 06/625,045, filed June 27, 1984 for "Improved Fuel Compositions", Mekonen et al.

This invention also provides sets and systems of chemical additives which remarkably improve both hydrocarbon fuels, per se and, as well, hydrosol fuels including a hydrocarbon component and a major water component.

The subject invention also has provided numbers of fuel compositions of (1) hydrocarbons, per se and additives, as well as (2) hydrocarbons, water and such additives, wherein less labor is required to manufacture, prepare and maintain such fuels (for example, these fuels not being viscous or needing heat in the cold months), wherein there are no nitrogen or sulfur bearing additives used in the fuel, per se or fuel hydrosol (water) compositions and yet wherein the costs of providing such hydrocarbon fuels, per se, with additives and water/fuel hydrosol compositions with additives are substantially reduced.

The invention has provided such (1) fuel, per se, compositions with additives and (2) hydrosol water/fuel compositions with additives which combust with substantially lower NOX and SOX emissions Still further, the subject invention provides hydrocarbon/water hydrosol fuel compositions with additives which require less quantities of surfactants to produce the hydrosol. Further, when it is desired to add surfactants to the approved hydrocarbon, per se fuel with additives, again, less quantities of surfactants are required for advantageous results.

From the foregoing, it will be seen that this invention is one well adapted to attain all of the ends and objects hereinabove set forth together with other advantages which are obvious and which are inherent to the fuel compositions.

It will be understood that certain features and subcombinations are of utility and may be employed without reference to other features and subcombinations as above stated. This is contemplated by and is within the scope of the claims.

I claim:

1. A hydrosol fuel comprising from about 67% to 94% by weight of a hydrocarbon combustible fuel selected from the group consisting of the gasolines, diesel fuels and heavy fuel oils, from 5 to 25% by weight of water, at least one surfactant operable to create a hydrosol with the fuel and water present in the range of 1.0 to 2.5 weight percent, and from 0.1 up to about 3.4% by weight of an additive selected from the group consisting of alpha (mono) olefins and alkyl benzenes, each of the former having 7 to 15 recurring $CH_2$ monomers therein.

2. A fuel as in claim 1 wherein the olefin has 7 to 13 recurring $CH_2$ monomers therein.

3. A fuel as in claim 1 including from 0.40 to 3.00% by weight of a toluene aromatic, the quantity of the additives selected from the group consisting of alpha olefins and alkyl benzenes being present in the range of 0.1 to 0.4 weight percent.

4. A fuel as in claim 1 including a pour point depressant present in the amount of 0.05 to 0.20 weight percent.

5. A fuel as in claim 1 including a metal hydroxide in the range of 0.05 to 0.2% by weight of available oxide.

6. A fuel as in claim 1 wherein the hydrocarbon fuel is present in the preferred range of about 78% by weight.

7. A hydrosol fuel as in claim 1 wherein the water is in the preferred range of about 20% by weight.

8. A hydrosol fuel as in claim 1 wherein the total surfactant agents are present in the preferred range of about 0.90% by weight.

9. A fuel as in claim 1 wherein the alpha olefin is present in the preferred range of about 0.1% by weight.

10. A fuel as in claim 1 wherein the alkyl benzene is present in the preferred range of about 0.1% by weight.

11. A hydrosol fuel comprising from about 67% to 94% by weight of a hydrocarbon combustible fuel selected from the group consisting of the gasolines, diesel fuels and heavy fuel oils, from about 5% to 25% by weight of water, at least one surfactant operable to create a hydrosol with the fuel and water present in the range of 1.0 to 2.5 weight percent and from 0.5 up to 3.4% by weight of an additive consisting of a mixture of alpha (mono) olefins and alkylbenzenes, each of the former having 7 to 15 recurring $CH_2$ monomers therein.

12. A hydrosol fuel comprising from about 67% to 94% by weight of a hydrocarbon combustible fuel selected from the group consisting of the gasolines, diesel fuels and heavy fuel oils, from 5% to 25% by weight of water, at least one surfactant operable to create a hydrosol with the fuel and water present tin the range of 1.0 to 2.5 weight percent, a mixture of alpha olefin and alkylbenzene, each of the former having 7 to 15 recurring $CH_2$ monomers therein, present in an amount up to about 0.4 weight percent and, further, a toluene aromatic is present in the amount of up to about 3.00 weight percent.

13. A fuel as in claim 1 wherein the fuel contains a toluene aromatic and mono olefins up to about 3.4% by weight.

14. A fuel as in claim 1 wherein a toluene aromatic is present and alkyl benzene, the toluene aromatic and alkyl benzene present being in from 0.5% up to about 3.4% by weight of the fuel.

15. A hydrosol fuel comprising from about 67% to 94% by weight of hydrocarbon combustible fuels selected from the group consisting of the gasolines, diesel fuels and heavy fuel oils, some 5 to 25% by weight of water, at least one surfactant operable to create a hydrosol with the fuel and water present in the range of about 1.0 to 2.5% by weight, from 0.5% to up to about 3.4% by weight of an additive selected from the group consisting of mono alpha olefins and alkyl benzenes, the former having 7 to 15 recurring $CH_2$ monomers therein, a pour point depressant in the range of 0.05 to 0.20% by weight and a metal hydroxide in the range of 0.05 to 0.2% by weight of available oxide.

16. A fuel as in claim 15 wherein the additive is an alpha olefin having 7 to 15 recurring $CH_2$ monomers therein present in the range of 0.1 to 0.4% by weight, the fuel including a toluene aromatic in the amount of 0.4 to 3.0% by weight.

17. A fuel as in claim 16 wherein the additive is an alkyl benzene present in a quantity of 0.1 to 0.4% by weight and the toluene aromatic is present in the amount of 0.4 to 3.0% by weight.

18. A hydrocarbon fuel comprising from about 67% to 97.6% by weight of a hydrocarbon combustible fuel selected from the group consisting of the gasolines, diesel fuels and heavy fuel oils, and from 0.1 up to about 3.4% by weight of an additive selected from the group consisting of alpha (mono) olefins ad alkyl benzenes, each of the former having 7 to 15 recurring $CH_2$ monomers therein.

19. A fuel as in claim 18 wherein the olefin has 7 to 13 recurring $CH_2$ monomers therein.

20. A fuel as in claim 18 including from 0.40 to 3.00% by weight of a toluene aromatic, the quantity of the additive selected from the group consisting of alpha olefins and alkyl benzenes being present in the range of 0.1 to 0.4 weight percent.

21. A fuel as in claim 18 including a pour point depressant present in the amount of 0.05 to 0.20 weight percent.

22. A fuel as in claim 18 including a metal hydroxide in the range of 0.05 to 0.2% by weight of available oxide.

23. A fuel as in claim 18 wherein the hydrocarbon fuel is present in the preferred range of about 98% by weight.

24. A fuel as in claim 18 wherein the alpha olefin is present in the preferred range of about 0.1% by weight.

25. A fuel as in claim 18 wherein the alkyl benzene is present in the preferred range of about 0.1% by weight.

26. A hydrocarbon fuel comprising from about 67% to 97.6% by weight of a hydrocarbon combustible fuel selected from the group consisting of the gasolines, diesel fuels and heavy fuel oils, and from 0.1 up to about 3.4 percent by weight of a mixture of alpha (mono) olefins and alkylbenzenes, each of the former having 7 to 15 recurring $CH_2$ monomers therein.

27. A hydrocarbon fuel comprising from about 67% to 97.6% by weight of a hydrocarbon combustible fuel selected from the group consisting of the gasolines, diesel fuels and heavy fuel oils, there being a mixture of alpha olefins and alkylbenzenes present in an amount up to about 0.4 weight percent and a toluene aromatic is present in the amount of up to about 3.00 weight percent.

28. A fuel as in claim 18 wherein the fuel contains a toluene aromatic and a mono olefin in the range of 0.5 up to about 3.4% by weight.

29. A fuel as in claim 18 wherein a toluene aromatic is present, as well as alkyl benzene, such compounds being present in from about 0.5% up to about 3.4% by weight of the fuel.

30. A fuel as in claim 18 including at least one surfactant operable to couple with any water contained in the fuel in the range of about 1.0 to 2.5% by weight.

31. A hydrocarbon fuel comprising from about 67 to 98% by weight of a hydrocarbon combustible fuel selected from the group consisting of the gasolines, diesel fuels and heavy fuel oils, from 0.1 up to about 0.4% by weight of an additive selected from the group consisting of alpha olefins and alkyl benzenes, each of the former having 7 to 15 recurring $CH_2$ monomers therein, from 0.4 to 3% by weight of a toluene aromatic and a pour point depressant in the amount of 0.05 to 0.20 weight percent.

32. A fuel as in claim 31 wherein the olefin has 7 to 13 recurring $CH_2$ monomers therein.

33. A fuel as in claim 31 including a metal hydroxide in the range of 0.05 to 0.2% by weight of available oxide.

34. A fuel as in claim 31 wherein the hydrocarbon fuel is present in the preferred range of about 97.9% by weight.

35. A fuel as in claim 31 including at least one surfactant operable to couple with any water present in the fuel in the range of about 1.0 to 2.5 weight percent.

36. A fuel as in claim 35 wherein the total surfactant is present in the preferred range of about 0.90% by weight.

37. A fuel as in claim 31 wherein the alpha olefin is present in the preferred range of about 0.1% by weight.

38. A fuel as in claim 31 wherein the alkyl benzene is present in the preferred range of about 0.1% by weight.

39. A fuel as in claim 31 where both alpha olefin and alkyl benzene are present in the range of 0.1 to 0.4% by weight.

40. A fuel as in claim 31 wherein the fuel contains a toluene aromatic and a mono olefin, said compounds present in 0.5 up to about 3.4% by weight of the fuel.

41. A fuel as in claim 31 wherein alkyl benzene and the toluene aromatic are present, said compounds being present in from about 0.5% up to about 3.4% by weight of the fuel.

* * * * *